US006648657B1

(12) United States Patent
Korsunsky et al.

(10) Patent No.: US 6,648,657 B1
(45) Date of Patent: Nov. 18, 2003

(54) ELECTRICAL CONNECTOR HAVING GROUND BUSES

(75) Inventors: Iosif R. Korsunsky, Harrisburg, PA (US); Joanne E. Shipe, Harrisburg, PA (US); Wei-Chen Lee, Harriburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/167,318

(22) Filed: Jun. 10, 2002

(51) Int. Cl.[7] ..... H01R 4/66

(52) U.S. Cl. ..... 439/108; 439/608

(58) Field of Search ..... 439/108, 497, 439/608, 101, 79, 636, 637, 947

(56) References Cited

U.S. PATENT DOCUMENTS

| | | | | | |
|---|---|---|---|---|---|
| 5,536,179 | A | * | 7/1996 | Olsson et al. | 439/108 |
| 6,152,742 | A | * | 11/2000 | Cohen et al. | 439/60 |
| 6,290,514 | B1 | * | 9/2001 | McHugh et al. | 439/108 |
| 6,338,635 | B1 | * | 1/2002 | Lee | 439/108 |
| 2002/0115318 | A1 | * | 8/2002 | Apicelli | 439/108 |

* cited by examiner

*Primary Examiner*—Hien Vu
(74) *Attorney, Agent, or Firm*—Wei Te Chung

(57) ABSTRACT

An electrical connector (1) comprises an insulative housing (10) defining a receiving cavity (18), a plurality of terminals (20) retained in the housing, and at least one ground bus module (30) received in the receiving cavity. Each ground bus module includes an insulative body (32) having a depressed inner surface in which the ground buses are integrally molded, and an opposite outer surface on which the mating beams of the terminals are positioned to be as close to corresponding terminals as possible to provide effective ground reference.

4 Claims, 6 Drawing Sheets

ELECTRICAL CONNECTOR HAVING GROUND BUSES

BACKGROUND OF THE INVENTION

1. Field of the Invention

The present invention relates to an electrical connector, and particularly to an electrical connector having a plurality of ground buses for enhancing signal transmission, especially in high frequency.

2. Prior Art of the Invention

U.S. Pat. No. 5,813,871 discloses an electrical connector assembly for interconnecting two circuit boards which transmit relatively high frequency signals. The electrical connector assembly includes a receptacle connector and a mating plug connector. The plug connector includes a central elongated ground plate which has a plurality of leads along its length for engaging with a circuit board. The leads extend from opposite sides of the ground plate at equal intervals.

The receptacle connector includes a base and a plurality of shield plates. The base has a cavity defined therein for receiving a mating portion of the plug connector and a central portion extending into the cavity with a slot defined therein extending lengthwise therethrough. When the plug connector and the receptacle connector are fully mated, the elongated ground plate of the plug connector extends substantially into the slot and is in electrical engagement with each of the shield plates of the receptacle connector. This provides a relatively short ground path from a first circuit board attached to the receptacle connector to a second circuit board attached to the plug connector, thereby significantly reducing crosstalk between two adjacent signal contacts of the electrical connector assembly.

However, the prior art discloses only a single ground plate within the plug connector, where the coplanarity of the ground plate is critical in the electrical connection with the shield plates of the receptacle connector. Accordingly, the electrical ground path will be negatively influenced because the coplanarity demand of the single ground plate is difficult to meet during manufacturing or due to other reasons which may result in some connections not being terminated. U.S. Pat. No. 6,338,635 having one common inventor and the same assigned with the instant invention, discloses some approach.

BRIEF SUMMARY OF THE INVENTION

A first object of the present invention is to provide an electrical connector having a plurality of ground buses which are arranged as close to the signal terminals as possible for providing reliable shielding.

A second object of the present invention is to provide an electrical connector having a plurality of ground buses which can be used for either grounding or power transmission.

In order to achieve the above mentioned objects, an electrical connector to be mounted on a printed circuit board in accordance with the present invention comprises an insulative housing having a bottom wall, a pair of side walls and a pair of end walls which cooperatively define a receiving cavity. A plurality of passageways are defined in the bottom wall and communicating with the receiving cavity. A plurality of terminals are retained in corresponding passageways of the insulative housing. At least one ground bus module is received in the receiving cavity and each includes a non-conductive body having an inner surface and an opposite outer surface on which the mating beams of the terminals are positioned. A plurality of ground buses are integrally and embededly molded with the inner surface of the non-conductive body for mating with corresponding grounding members of the complementary connector, thereby being close enough to corresponding terminals to therefore provide effective ground reference.

Other objects, advantages and novel features of the invention will become more apparent from the following detailed description of the present embodiment when taken in conjunction with the accompanying drawings.

DETAILED DESCRIPTION OF THE INVENTION

Figure 1:
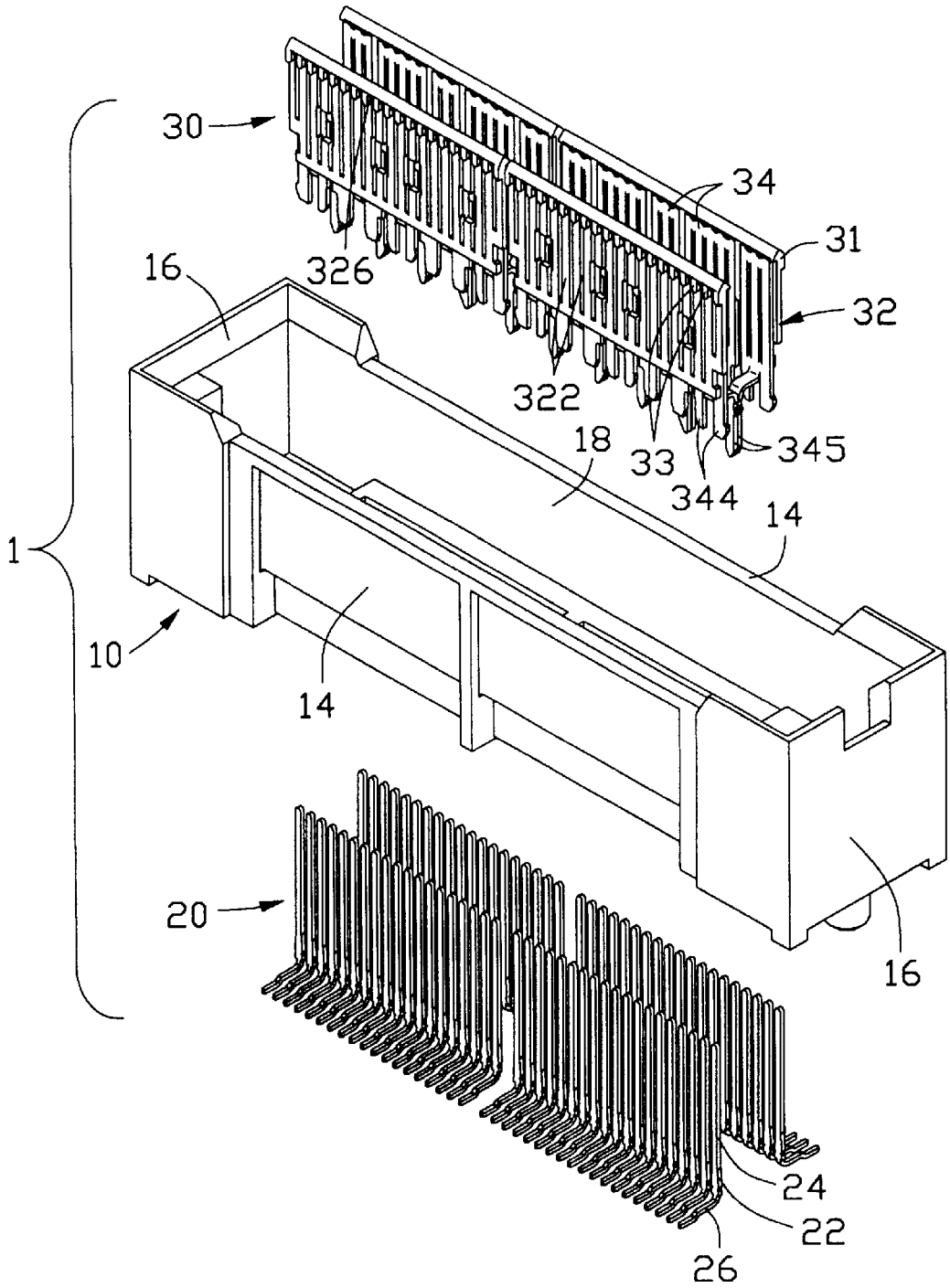
FIG. 1 is a perspective view of an electrical connector in accordance with the present invention.
Figure 2:
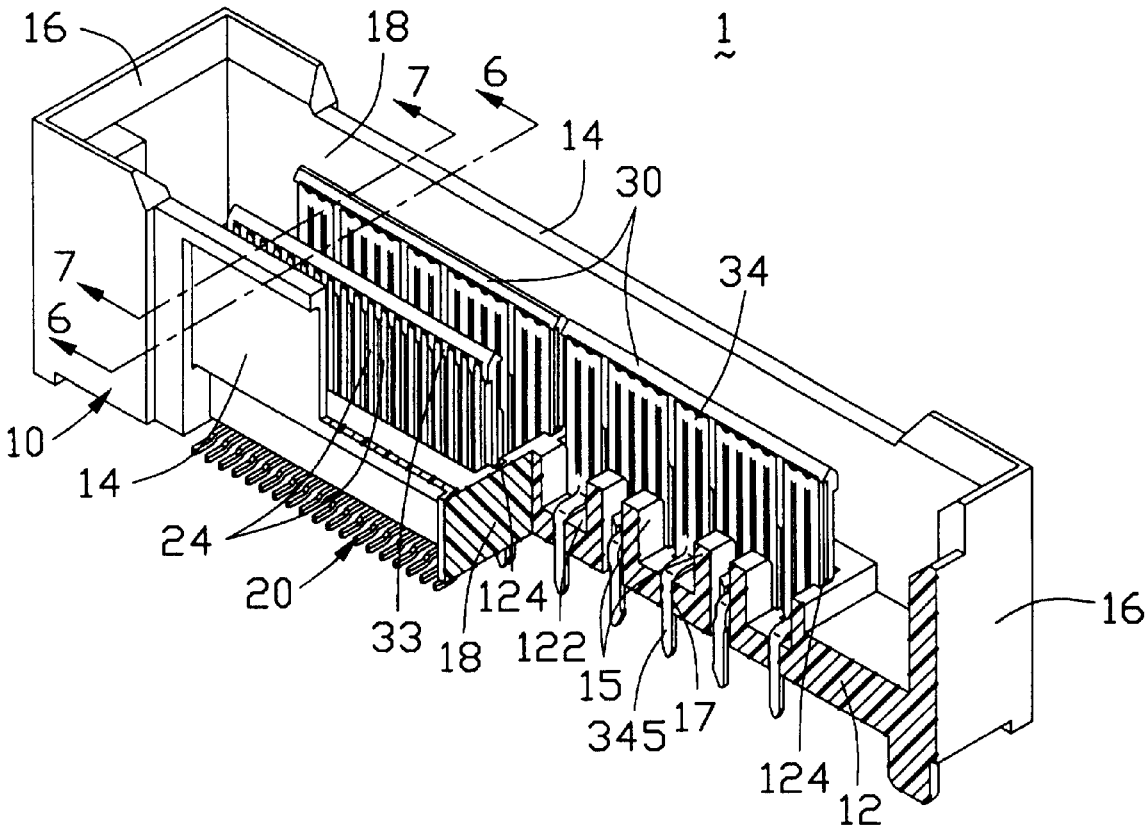
FIG. 2 is an assembled view of FIG. 1 having a partial cross section.
Figure 3:
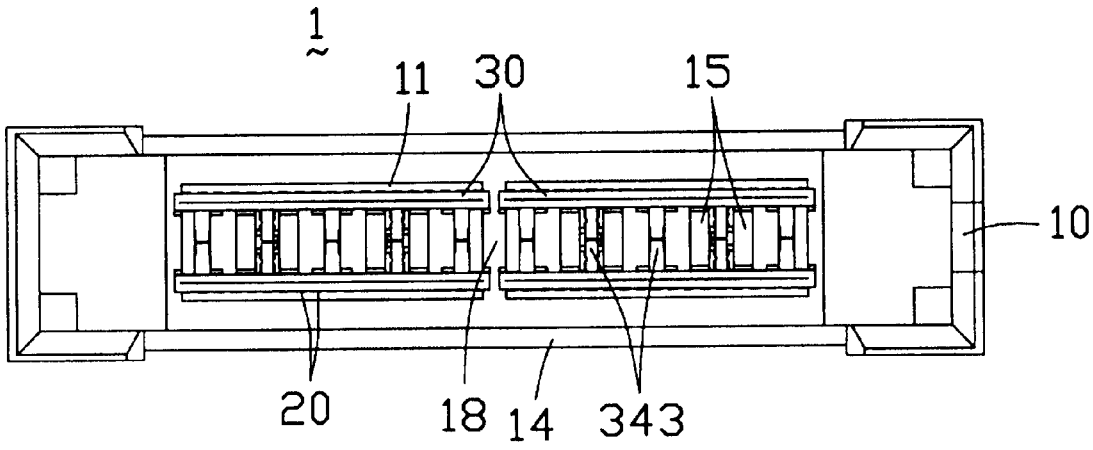
FIG. 3 is a top view of FIG. 2, removing the partial cross section.
Figure 4:
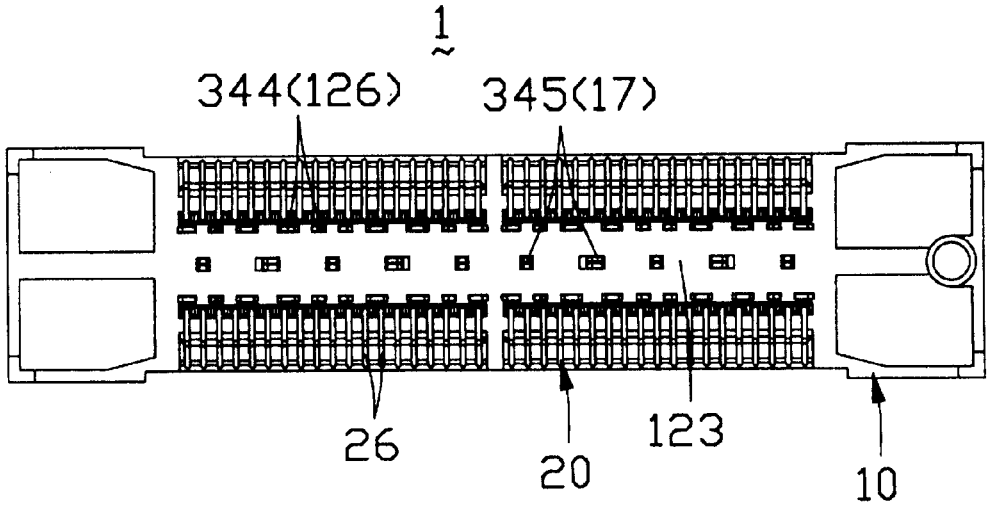
FIG. 4 is a bottom view of FIG. 2, removing the partial cross section.
Figure 5:
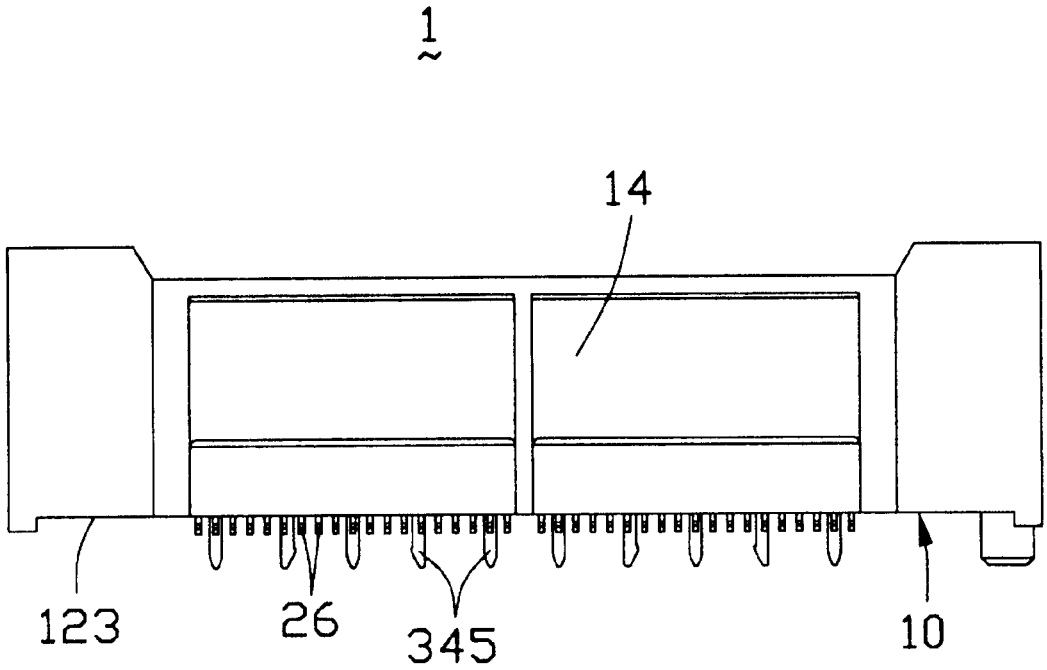
FIG. 5 is a side view of FIG. 2, removing the partial cross section.

Referring to FIG. 1, an electrical connector 1 in accordance with the present invention comprises an insulative housing 10, a plurality of signal terminals 20 and a plurality of ground bus modules 30 both assembled with the housing 10.

Further referring to FIGS. 2 to 5, the insulative housing 10 is preferably shaped in a concave rectangular form and has a bottom wall 12, a pair of side walls 14 and a pair of end walls 16 both projecting from the bottom wall 12, which cooperatively define a receiving cavity 18. The bottom wall 12 defines a pair of slots 11 in opposite sides thereof, two rows of passageways 13 (see FIG. 6) and two rows of retaining holes 126 (FIG. 4) both extending through the bottom wall 12, beneath and communicating with the slot 11. A plurality of positioning blocks 15 project upward from a top face 122 of the bottom wall 12. A through hole 17 is defined between every two adjacent blocks 5. Additionally, a partition plate 19 is aged between the side walls 14 and divides the slots 11 into several sections. Furthermore, several slits 124 are defined in both the bottom wall 12 and the partition plate 19 for positioning the ground bus modules 30, as will be described below.

The signal terminals 20 are formed in high density for transmitting high frequency and speed signals, and arranged in two rows for insertion into corresponding passageways 13. Each terminal 20 is preferably shaped in an "L" and forms a retaining portion 22 retained in the passageway 13, an elongated mating beam 24 projecting upward from one end of the retaining portion 22 for mating with a corresponding contact of a complementary connector (not shown), and a soldering tail 26 horizontally extending from the other end of the retaining portion 22 for being soldered to the circuit board.

Figure 6:
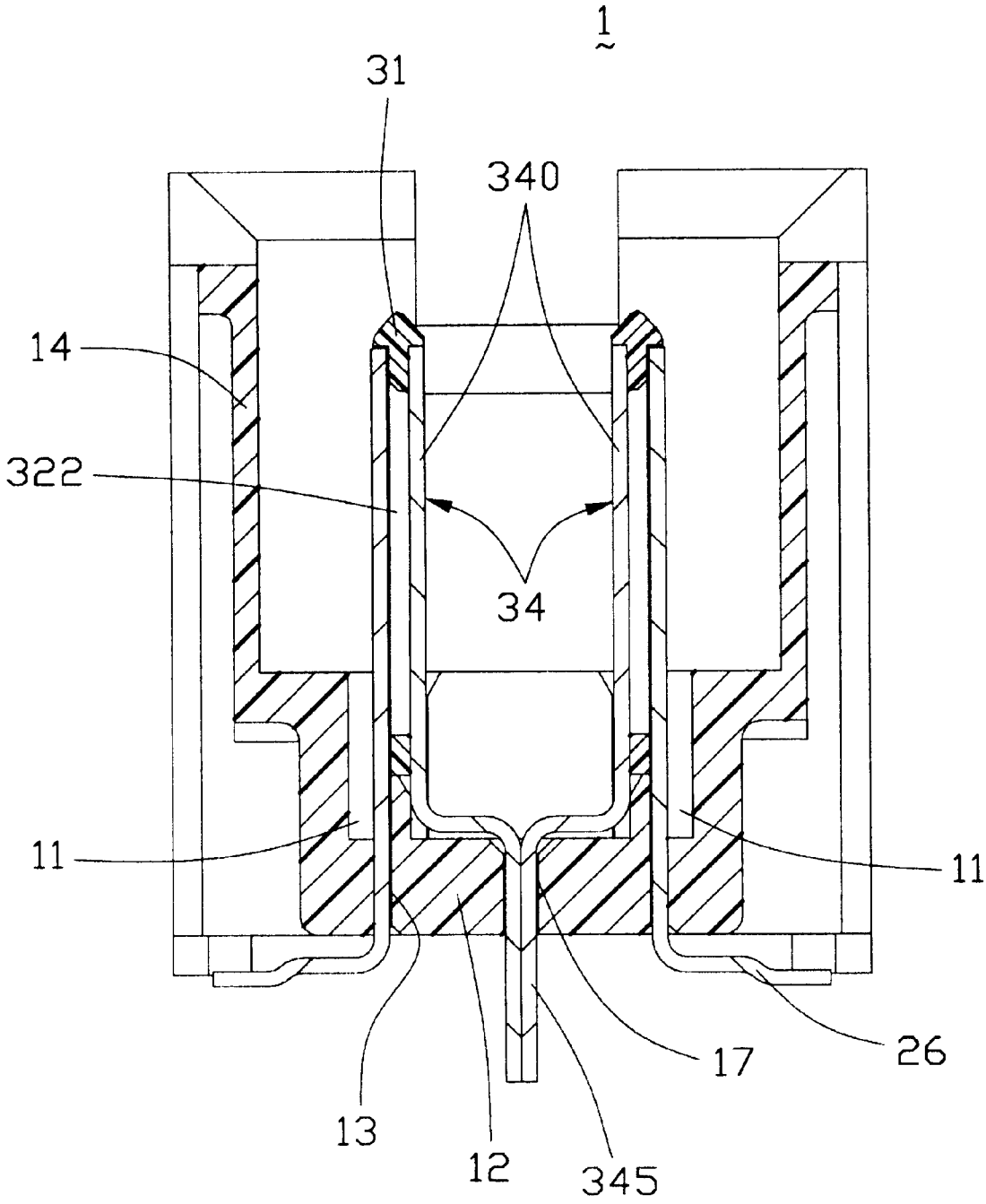
FIG. 6 is a cross-sectional view of taken along line 6—6 of FIG. 2.
Figure 7:
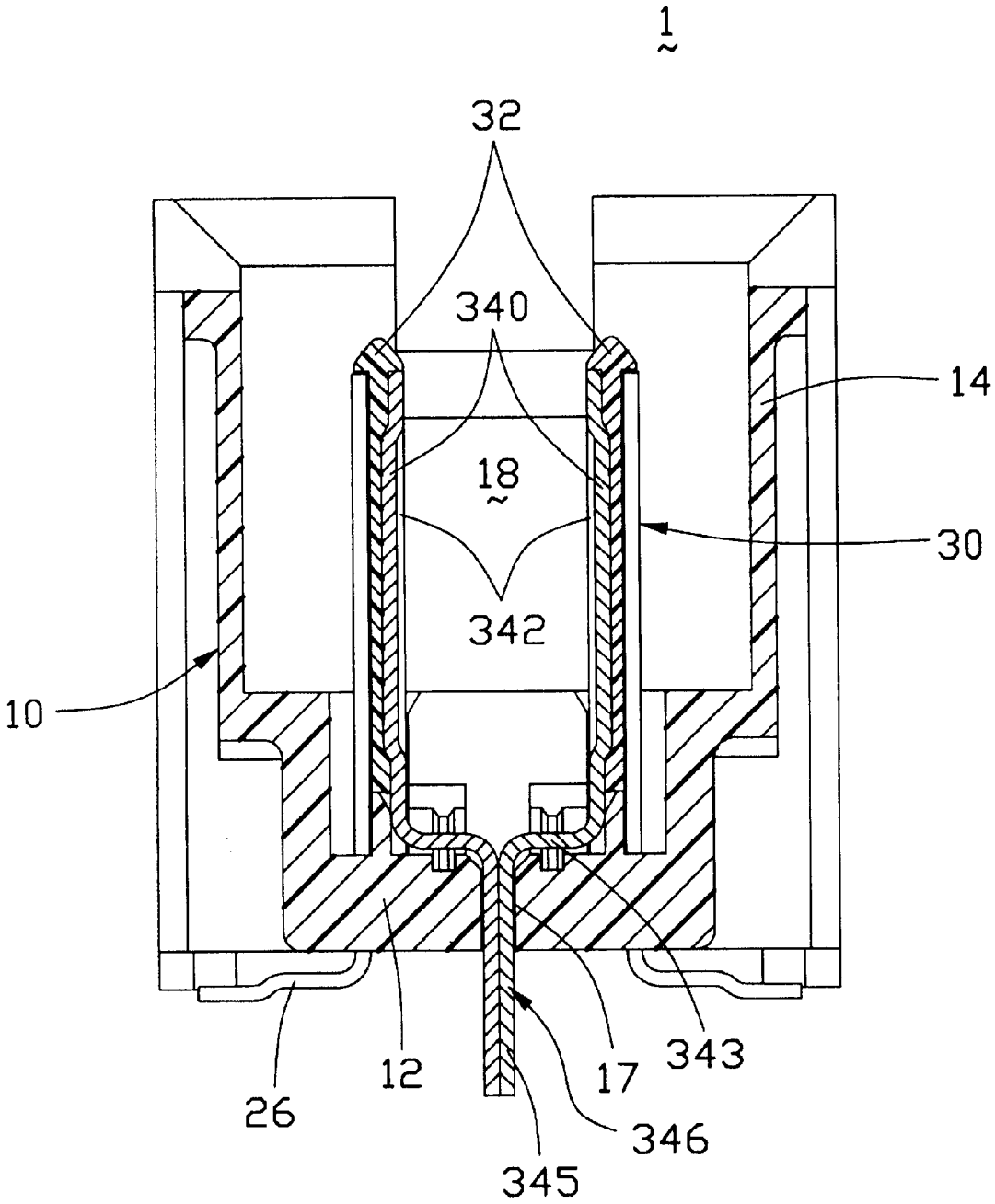
FIG. 7 is a cross-sectional view taken along line 7—7 of FIG. 2.

Further referring to FIGS. 6 and 7, according to a preferred embodiment of the present invention, a plurality of ground bus modules 30 symmetrically arranged in two rows are inserted into corresponding slots 11 of the housing 10. Each ground bus module 30 has a body plate 32 made of the insulative material, and a plurality of ground bus 34 integrally molded with the body plate 32. The body plate 32 has an arc-shaped upper edge 31 and the ground buses 34 are integrally molded in the inner surface of the body plate 32. Thus, the ground buses 34 are embedded in the body plate 32 so as to be as close to the corresponding signal terminals 20 as possible, as will be explained hereinafter. By this arrangement, the ground buses 34 benefit from the shortest distance possible with respect to the signal terminals 20, thereby providing reliable and enhanced grounding reference performance. A plurality of positioning ribs 33, spaced apart from each other, extend downward from an outer surface (not labeled) of the upper edge 31, defining a corresponding number of channels 326 therebetween for receiving the mating beams 24 of corresponding terminals 20. The body plate 32 further defines a plurality of elongated slits 322 extending through opposite surfaces of the thereof. Each ground bus 34, made of metal material, has a plate-like configuration and includes a plate section 340. The plate section 340 defines a plurality of notches 342 to make the ground be as close to the signal terminals 20 as possible, so as to reduce the cross talk between the signal terminals 20. A pair of retaining legs 344 and a soldering tail 346 between the retaining legs 344 extend from a lower edge of the body plate 340. The retaining legs 344 are interferingly retained into corresponding holes 126 (see FIG. 4) defined in the bottom wall 12 of the housing 10 for retaining the ground bus module 30 in place. The solder tail 346 is in an "L" shape and has a horizontal section 343 horizontally extending from the lower edge of the body section 340 and a vertical section 345 vertically extending downward from the horizontal section 343. The vertical sections 345 of two opposite ground buses 34 in the two rows are abutted against with each other to be interferingly inserted into a common through hole 17 of the housing 10.

In assembly, referring to FIGS. 1 to 7, the ground bus modules 30 are first inserted into corresponding slots 11 of the housing 10 from the above of the housing 10. The retaining legs 344 of the ground buses 34 are inserted into the corresponding retaining holes 126 of the housing 10 to retain the ground bus modules 30 in position. The vertical sections 345 of the soldering tails 346 of every two opposite ground buses 34 are juxtaposely inserted into a common positioning hole 17 of the housing 10 and extend beneath the housing 10 for soldering to the circuit board. Additionally, opposite side edges of the ground bus modules 30 are engaged with corresponding slits 124 of the housing 10 to retain the ground bus modules 30 in position. Then, the terminals 20 are inserted into corresponding passageways 13 from the underside of the housing 10 and the mating beams 24 thereof extend along the outer surface of the ground bus modules 30 to have upper portions thereof positioned between corresponding ribs 33 or in corresponding channels 326 of the body plate 32. Thus, an assembled electrical connector 1 in accordance with the present invention is obtained, ready for being mounted onto the circuit board.

From the above description, it is seen that the ground buses 34 in accordance with the present invention can provide not only a ground reference function for the signal terminals 20, but also be used for transmitting power between the related devices. Additionally, since the ground buses 34 are embedded in one side of the body plate 32 so as to be as close to the signal terminals 20 as possible, they provide much more reliable and effective ground reference function and can reduce crosstalk between adjacent signal terminals 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a circuit board, comprising:

an insulative housing defining a receiving cavity and a plurality of passageways communicating with the receiving cavity;

a plurality of ground bus modules being received in the receiving cavity and each including an insulative body, a plurality of ground buses integrally embedded in one side of the insulative body for mating with corresponding grounding members of the complementary connector; and a plurality of signal terminals each having a retaining portion retained in a corresponding passageway, a mating portion projecting from one end of the retaining portion for mating with a corresponding contact of the complementary connector, and a soldering portion extending from another end of the retaining portion for being soldered to the circuit board, the mating portions of the signal terminals positioned on another side of the insulative body of the ground bus module and opposite to the ground buses; wherein the bottom wall of the housing defines a pair of slots in a top face at opposite sides thereof; wherein the insulative body of each ground bus module forms a plurality of positioning ribs extending from the upper edge of the outer surface thereof, a channel is defined between every two adjacent positioning ribs to receive a part of the mating beam of a corresponding signal terminal; wherein each ground bus of the ground bus module has a plate-like body, a pair of retaining legs and a soldering tail between the retaining legs, the retaining legs and the soldering tail both extending downward from a lower edge of the plate-like body; wherein the bottom wall of the housing further defines two rows of retaining holes beneath and communicating with the two rows of slots for receiving the retaining legs of the ground buses; wherein the bottom wall of the housing forms a row of positioning blocks in the receiving cavity for retaining the ground bus modules in position; wherein each ground bus defines several elongated notches in an outer surface thereof so as to be as close to corresponding signal terminals as possible.

2. The electrical connector as claimed in claim 1, wherein the ground bus modules are arranged in two rows to be inserted into the slots of the housing.

3. The electrical connector as claimed in claim 1, wherein the soldering tail of each ground bus has a horizontal section extending inward from the lower edge of the plate-like body of the ground bus, and a vertical section vertically extending from the horizontal section.

4. The electrical connector as claimed in claim 3, wherein a positioning hole is defined between every two adjacent positioning projections, and wherein the vertical sections of the soldering tails of two facing ground buses arranged in two rows are abutted against with each other for common insertion into the positioning hole.

* * * * *